US005235931A

United States Patent [19]

Nadolink

[11] Patent Number: 5,235,931

[45] Date of Patent: Aug. 17, 1993

[54] INFLATABLE UNDERSEA VEHICLE SYSTEM OF SPECIAL UTILITY AS A DAUGHTER VESSEL TO A MOTHER VESSEL

[75] Inventor: Richard H. Nadolink, Portsmouth, R.I.

[73] Assignee: The United States of America as represented by the Secretary of the Navy, Washington, D.C.

[21] Appl. No.: 916,758

[22] Filed: Jul. 22, 1992

[51] Int. Cl.[5] ..... B63G 8/00

[52] U.S. Cl. ..... 114/321; 114/322; 114/338; 114/333; 114/257

[58] Field of Search ..... 114/256, 312, 313, 320, 114/321, 322, 345, 257, 333, 121, 122; 440/88

[56] References Cited

U.S. PATENT DOCUMENTS

| | | | |
|---|---|---|---|
| 3,688,721 | 9/1972 | Bennett | 114/321 |
| 3,698,339 | 10/1972 | Golay et al. | 114/321 |
| 3,897,743 | 8/1975 | Schoonman | 114/321 |
| 4,010,619 | 3/1977 | Hightower et al. | 114/322 |
| 4,227,477 | 10/1980 | Preus | 114/256 |

*Primary Examiner*—David M. Mitchell
*Assistant Examiner*—Stephen P. Avila
*Attorney, Agent, or Firm*—Michael J. McGowan; Prithvi C. Lall; Michael F. Oglo

[57] ABSTRACT

The submersible vehicle system of the present invention comprises a unitary undersea vehicle composed of a rigid hull submersible mated to an inflated auxiliary submersible. Both the rigid hull submersible and the auxiliary submersible may be initially stored aboard a mother vessel. The auxiliary submersible is provided with one or more compartments for storing fuel and/or ballast, either positive or negative.

8 Claims, 5 Drawing Sheets

INFLATABLE UNDERSEA VEHICLE SYSTEM OF SPECIAL UTILITY AS A DAUGHTER VESSEL TO A MOTHER VESSEL

STATEMENT OF GOVERNMENT INTEREST

The present invention described herein may be manufactured and used by or for the Government of the United States of America for governmental purposes without the payment of any royalties thereon or therefor.

BACKGROUND OF THE INVENTION (1) Field of the Invention

The present invention relates to a submersible vehicle system including a rigid hull submersible component and an inflatable auxiliary submersible component for holding fuel and/or ballast. The submersible vehicle system may be used for a wide variety of underwater missions.

(2) Prior Art

A wide variety of underwater vehicle systems have been developed over the years for a wide variety of purposes. U.S. Pat. No. 3,330,238 to Ghoughasian for example is directed to an underwater propulsion unit to be mated to a submersible such as a submarine, torpedo or underwater missile. The propulsion unit includes an annular shroud formed by two substantially hemispherical sections and a propulsion unit within the shroud.

U.S. Pat. No. 4,271,522 to Sandler is directed to an on-board recovery system for a submersible such as a torpedo. The recovery system comprises an expandable sleeve surrounding a portion of the torpedo and housed therein in a deflated state. When one wishes to recover the torpedo, the sleeve is expanded to form a doughnut shaped floatation collar.

U.S. Pat. No. 4,226,205 to Bastide exemplifies a local transport submersible for divers. The submersible includes a main body formed from two hemispherical elements connected by a circular-base cylinder, a system of trim tanks and a lightweight body containing diving ballasts surrounding the main body. The lightweight body has an external shape which is rounded throughout and completely smooth.

Most current undersea submersibles such as torpedoes and unmanned undersea vehicles with conventional thermal or electric power sources are severely limited by the raw amount of fuel that can be carried on-board. These fuel limitations are directly related to the constraints and penalties dictated by the host or mother vessel which initially stores and launches the submersible. Many remotely operated vehicles alter this constraint by providing the energy source over a tether run from the mother submersible to the daughter vehicle. The daughter vehicle usually has electric motors and/or electric/hydraulic systems that need to be powered. Electrical power is supplied to the daughter vehicle over the tether cable from the mother vehicle.

Endurance is only governed by the capacity of the mother vehicle's energy. However, these conventional means of tethering provide large constraints on the mobility and autonomy of both the mother and daughter vehicles, and in the case of unmanned underwater vehicles, restrict mission potential.

Accordingly, it is an object of the present invention to provide a submersible vehicle system which does not suffer from the constraints imposed by prior art systems.

It is a specific object of the present invention to provide a submersible vehicle system as above having enhanced endurance and enhanced mission flexibility.

It is yet a further object of the present invention to provide a submersible vehicle system as above which may be fueled from a mother vessel and/or other fueling stations.

It is still a further object of the present invention to provide a submersible vehicle system as above which may be launched from a conventional submersible.

These and other objects and advantages of the present invention will become clearer from the following description and drawings in which like reference numerals depict like elements.

SUMMARY OF THE INVENTION

The foregoing objects are attained by the submersible vehicle system of the present invention which comprises a unitary undersea vehicle composed of a submersible component having a rigid hull structure and a source of propulsion and an auxiliary submersible component having an inflatable hull structure and a central opening for receiving a forward portion of the rigid hull submersible component. The auxiliary submersible component preferably at least partially surrounds the rigid hull structure component. In this context, the term "auxiliary" is used in the sense of being the component of the unitary undersea vehicle that contains expendables such as fuels and ballast, whereas the rigid hull structure submersible component contains non-expendables such as the source of propulsion, sonar sensors, guidance and control devices, an additional or alternate energy source, and auxiliary controls.

The rigid hull submersible component and the inflatable hull auxiliary submersible component may be launched separately from a mother vessel such as a submarine or underwater platform and mated together underwater. The rigid hull submersible component may be a torpedo, a manned vehicle or an unmanned vehicle.

The inflatable hull submersible component preferably has a plurality of compartments for holding fuel and/or ballast. The inflatable hull submersible component further has means for connecting each compartment with a supply of fuel and/or ballast stored aboard the mother vessel.

The method of forming in-situ and using the submersible vehicle system of the present invention includes the steps of: launching the rigid hull submersible component and the inflatable submersible component from a mother vessel; inflating the inflatable submersible component with at least one desired fluid; and mating the rigid hull submersible component to the inflated submersible underwater component.

The system of the present invention presents the following advantages:

(a) extremely long endurance capability due to the large fuel storage without taking the shape, weight and volume penalties ordinarily encountered by an initially large submersible inside or adjacent to the mother vessel;

(b) the ability to be easily refueled at intermediate stations or by other submersibles with a simple docking and refueling mechanism other than a launch and retrieval system; and (c) the ability to more easily retrieve the rigid hull submersible and the deflated auxiliary submersible, if desired, after mission termination by a wide variety of surface and submerged craft.

Other details of the present invention are set out in the following description.

DESCRIPTION OF THE PREFERRED EMBODIMENT

Figure 1:
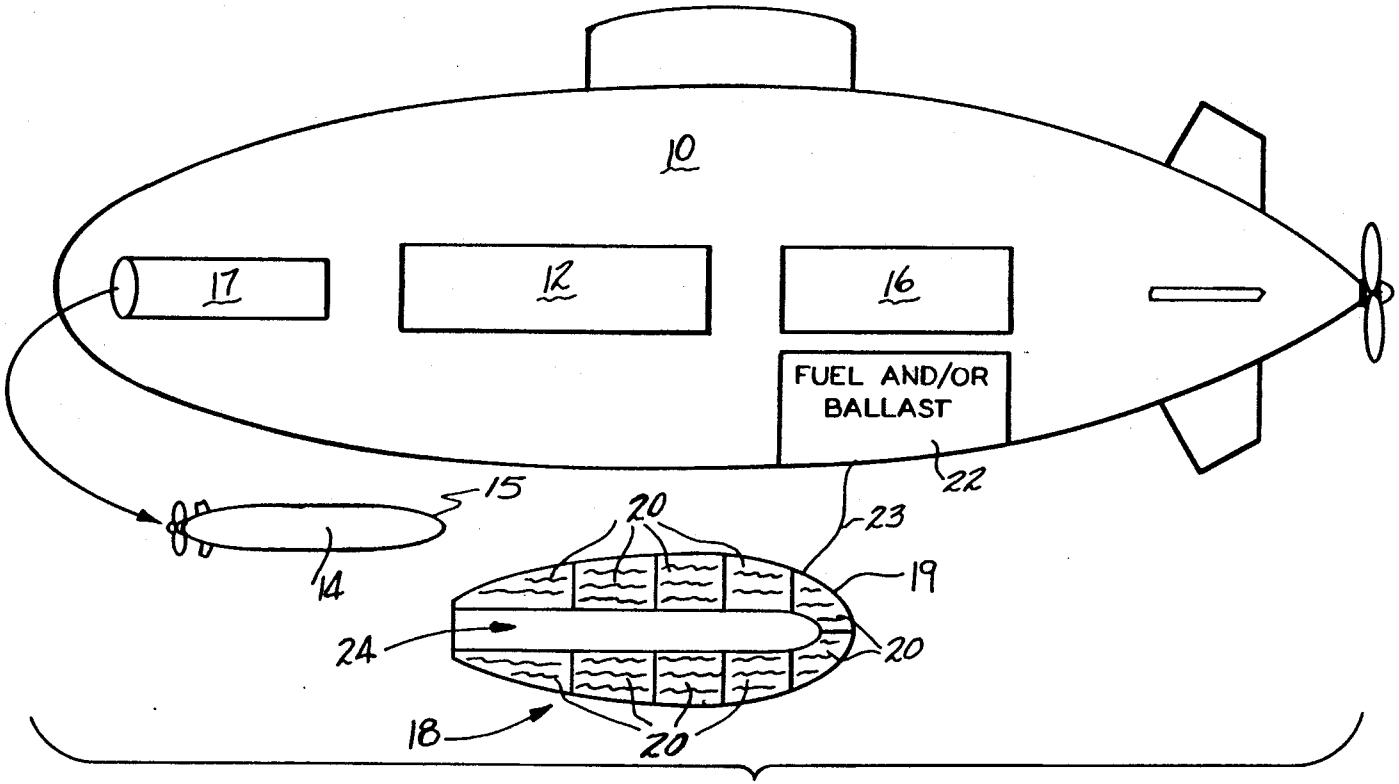
FIG. 1 is a schematic representation of a mother vessel having storage compartments and launch systems for the submersible vehicle system components.

Referring now to the drawings, FIG. 1 illustrates a mother vessel 10 for storing and launching the components of the submersible vehicle system of the present invention. The mother vessel 10 may be a submarine, an underwater platform or any other vessel. The submersible vehicle is a unitary undersea vehicle.

The mother vessel 10 may have one or more compartments 12 for storing one component thereof, namely a rigid hull submersible 14 such as a torpedo, a manned vehicle, an unmanned vehicle, a tethered vehicle, or an untethered vehicle. The rigid hull submersible 14 may have on-board a source of propulsion, sonar, sensors, guidance and control devices, an additional or alternate energy source, an engine, auxiliary controls and other non-expendable products needed to complete a desired mission. When launched from the mother vessel, the rigid hull submersible requires a small amount of initial energy for stability, control and docking. If desired, this energy may be provided by connecting the rigid hull submersible to the mother ship's power source using a tether (not shown), constituting the rigid hull vehicle a remotely operated vehicle ("ROV") for the period the tether is employed.

The mother vessel 10 may also have one or more compartments 16 for storing another component of the unitary undersea vehicle, i.e., an auxiliary submersible 18 having an inflatable hull. If desired, the compartment(s) 16 may be located adjacent the hull skin of the mother vessel and may have a hatch (not shown) that opens to the water. A suitable ejection device (not shown) may be included in the compartment(s) if desired. The auxiliary submersible 18 is preferably stored aboard the mother vessel in a compact or uninflated minimum volume, condition. In this context, the term "auxiliary" is used in the sense of being the component of the unitary vehicle that contains expendables such as fuels and ballast, whereas the rigid hull submersible 14 mainly contains non-expendables such as: (i) the source of propulsion; (ii) the payload including sonar sensors, guidance and control devices; (iii) an additional or alternate energy source; and (iv) auxiliary controls.

The mother vessel 10 may be provided with any suitable means 17 known in the art to independently launch the rigid hull submersible 14; and (although not shown in the drawing) could also be provided with a suitable means to launch the auxiliary submersible 18. If desired, the same launcher may be used to launch the submersibles 14 and 18. Obviously, the nature of the submersibles 14 and 18 will determine the precise nature of the launcher(s) 17. It is preferred however that the launching system for each submersible component 14 and 18 allow an underwater launch.

The auxiliary submersible 18 is preferably formed as an inflatable cocoon or bladder having a hull skin 19 formed from a construction material such as rubber, neoprene or any other suitable elastomeric material. A bonded layer of fabric strength material (anti-puncture) may be added to provide strength reinforcement. Ideally, the material forming the hull skin 19 is flexible, tough and waterproof. The material should also be capable of withstanding a relatively high differential pressure of gas or liquid in the range of 50–100 psid (i.e., differential pressure vice or gauge pressure —psig—) which could occur when the auxiliary submersible 18 contains positive ballast or negative ballast/fuel.

The auxiliary submersible 18 preferably has a compartmented internal structure with a plurality of compartments 20 for storing fuel and/or dischargeable ballast, either positive or negative. The fuel and/or ballast may be transferred from one or more fuel and/or ballast sources 22 aboard the mother vessel or some other remote vessel or station. The internal compartmented structure may be formed by internal baffles and/or internal cells constructed from the same material as the outer hull skin 19. Preferably, the auxiliary submersible 18 is constructed so that the compartments 20 can be erected by inflation on a compartment-by-compartment basis.

The compartments 20 are preferably in fluid communication with each other so that gases and fluids may be passed from one compartment to another. Fluid communication between compartments can be accomplished by passive valves or fluid passageways (not shown). Such an arrangement allows the submersible to maintain shape, trim and/or differential pressure. Additionally, such an arrangement allows the compartments to be backfilled with ambient water as the expendables, in the compartments are consumed or discharged.

Figure 2:
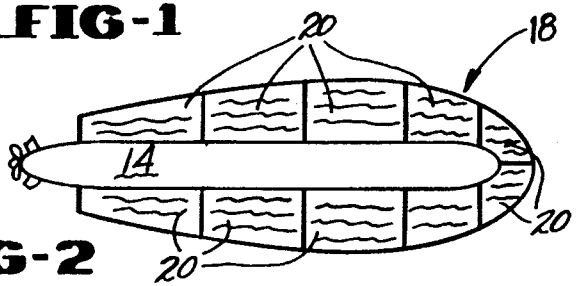
FIG. 2 is a cross sectional view of a rigid hull submersible component mated to an inflatable hull auxiliary submersible component to form a unitary undersea vehicle in accordance with the present invention.

FIGS. 1 and 2 illustrate one configuration of the auxiliary submersible 18. As shown therein, the submersible 18 in its inflated state has a central opening 24 for receiving a portion of the rigid hull submersible 14 including the bow 15 thereof.

Figure 3:
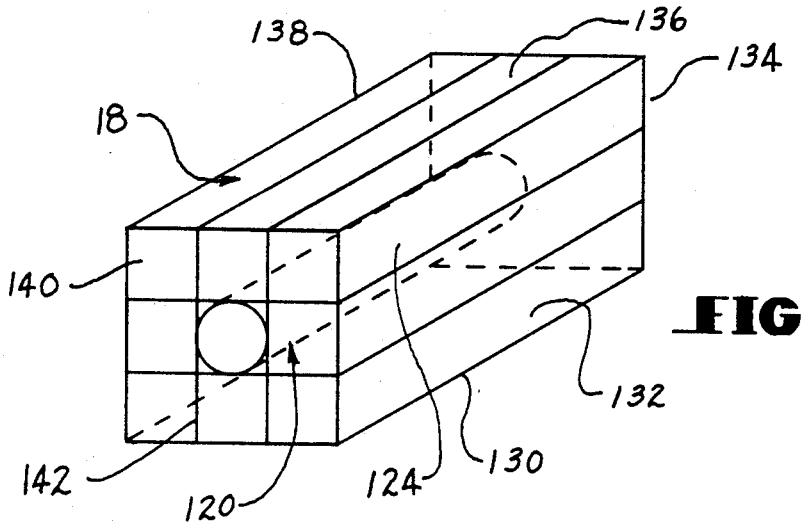
FIGS. 3 and 4 illustrate an alternative embodiment of the auxiliary submersible component of the undersea vehicle system.
Figure 4:
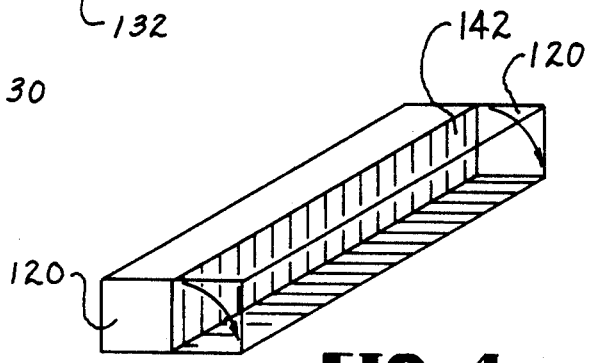

FIG. 3 illustrates an alternative construction for the auxiliary submersible component. In this figure, the auxiliary submersible 18 comprises a sleeve having a rectangularly shaped outer surface and a central cylindrical opening 124 for receiving a portion of the rigid hull submersible 14. The external surfaces 130, 132, 134, 136, 138 and 140 of the submersible 18 may be constructed of a single piece of material or may be formed from a number of sections bonded together to form a continuous sleeve. The internal compartments 120 may be defined by longitudinal barriers or stiffeners 142 and may be connected together in the form of fixed cells by bonding. Fluid communication between the compartments 120 may be completed by many holes with optional passive check valves. The barriers or stiffeners 142 may be completely connected to the internal compartment structure or they may be formed as hinged flaps (see FIG. 4).

This type of construction for the auxiliary submersible is advantageous in that it can be easily collapsed into a substantially flat, compact package by proper folding of the internal cell walls and folding of the sleeve along the borders and seams of the external skin.

Figure 5A:
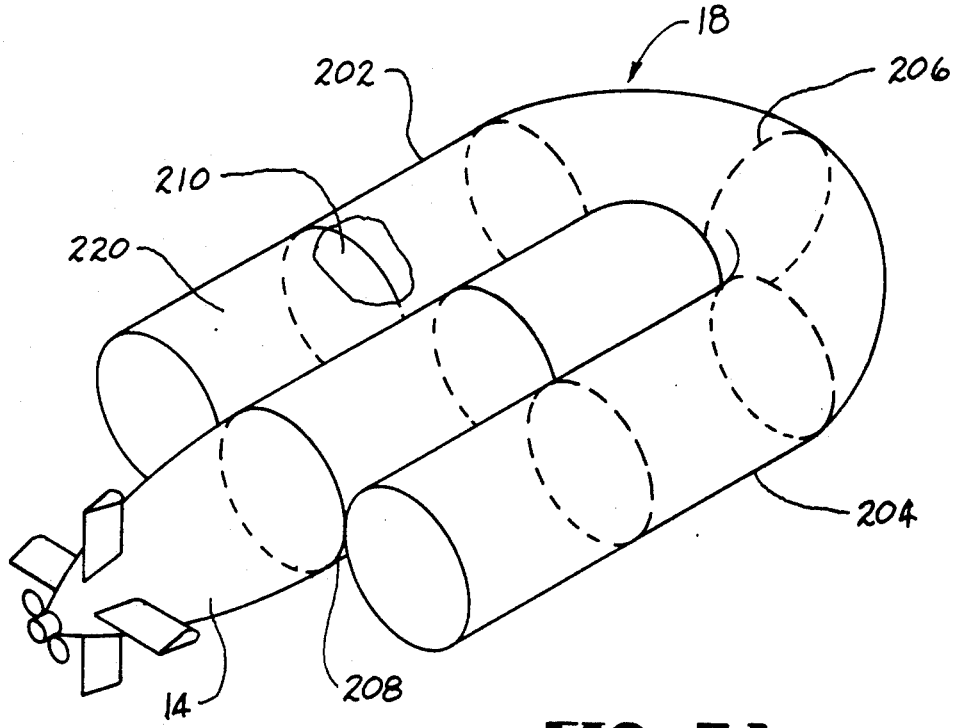
FIGS. 5A and 5B are respectively, (i) a diagrammatic pictorial tending to be a perspective view and (ii) a diagrammatic pictorial tending to be partially top plan and partially a cross section, illustrating yet another embodiment of the auxiliary submersible component of the undersea vehicle system with FIGS. 5C, 5D, 5E and 5F illustrating a folding process related to this embodiment.
Figure 5E:
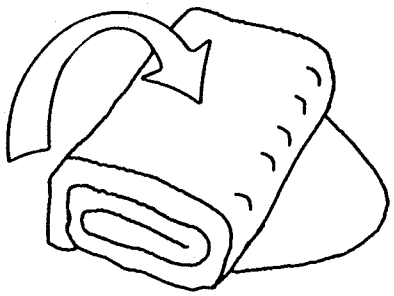
Figure 5F:
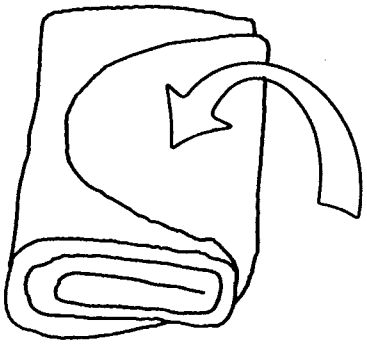
Figure 5C:
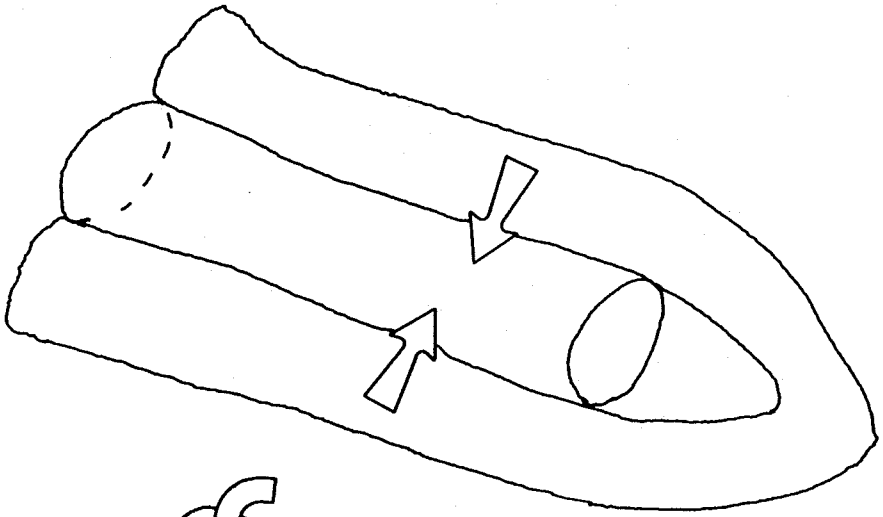
Figure 5D:
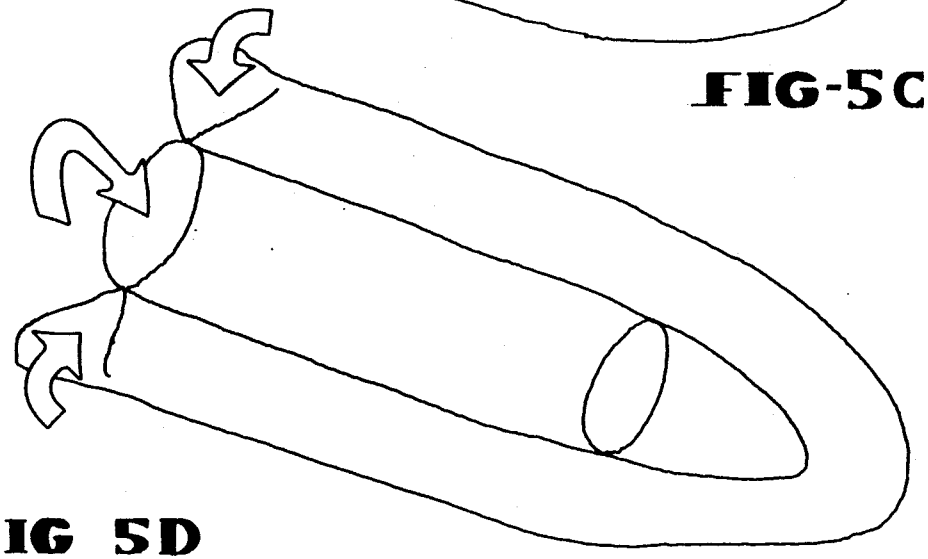
Figure 5B:
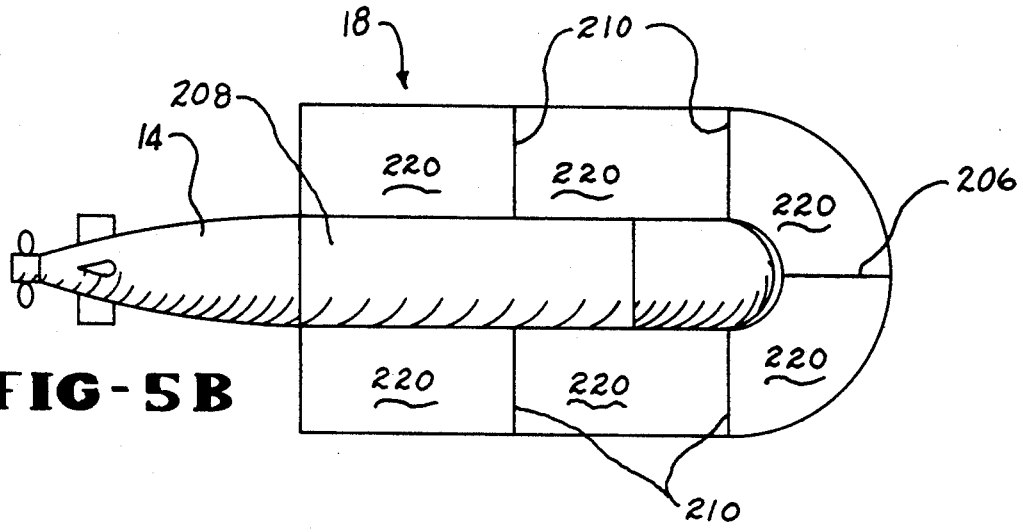

FIGS. 5A and 5B illustrate yet another type of construction for the auxiliary submersible. In this embodiment, the auxiliary submersible 18 is formed by two external pontoon type inflatable members 202 and 204, joined together at a nose portion 206, and a central hollow sleeve 208. The inflatable members 202 and 204 are each internally compartmented. A plurality of barriers 210 with passive check valves incorporated therein are provided to form the internal compartments 220. The central hollow sleeve body of the rigid submersible 14. The inflatable members 202 and 204 may have the same diameter as or a greater diameter than the diameter of the rigid submersible.

The process by which members 202, 204, 206, and 208, may be folded into their minimum volume for is illustrated in FIGS. 5C, 5D, 5E, and 5F.

Figure 6A:
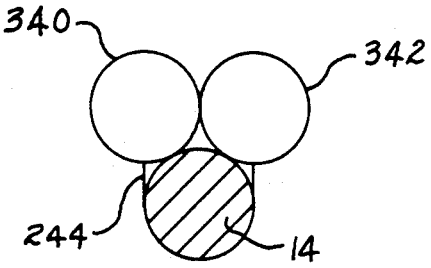
FIGS. 6A and 6B are (i) a diagrammatic pictorial tending to be a cross section view, and (ii) a diagrammatic pictorial tending to a perspective view; illustrating still another embodiment of the auxiliary submersible component of the undersea vehicle system.
Figure 6B:
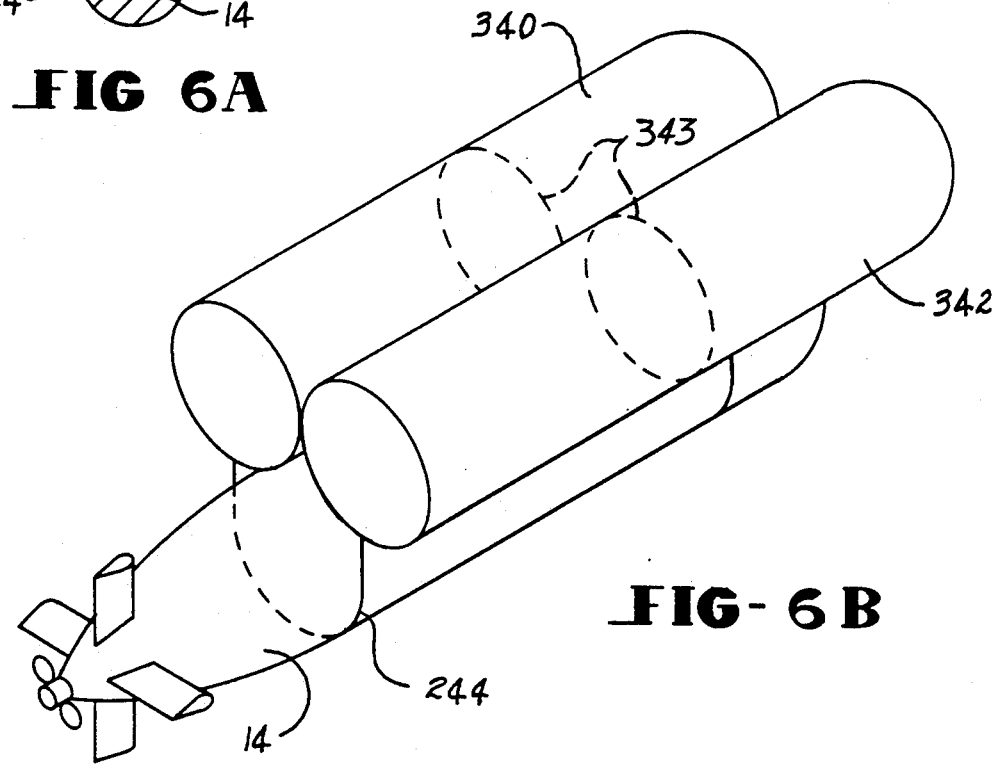

In still another embodiment of the present invention, FIGS. 6A and 6B, the auxiliary submersible 18 is formed by two pontoon-type inflatable members 340 and 342 mated together in an abutting or side-by-side relationship. As before, the pontoon-type members may each have a plurality of internal compartments in fluid communication with each other. The compartments may be formed by one or more barrier walls depicted as hidden lines 243.

A sling 244 is provided to enable a rigid submersible 14 to be mated to the auxiliary submersible 18. The sling 244 may be formed from any suitable material. Preferably it is formed from the same material as the members 240 and 242. It may be joined to the lower surface of each member 240 and 242 by any suitable means known in the art. For example, it could be attached to a lower surface of the pontoon- type members by stitching or an adhesive.

The sling 244 may have any desired length. For example, it may extend along the entire length of the pontoon members or along a substantial portion thereof.

In all of the embodiments described herein, the sides and ends of the inflatable portions of the auxiliary submersible component may be faired if desired so as to minimize resistance or drag during operation. Fairing may be accomplished using any suitable means known in the art. If fairing is accomplished by attaching a fairing compartment to the inflatable member, the fairing compartment can also be used as a storage compartment.

As previously discussed, the inflatable auxiliary submersible 18 is stored aboard the mother vessel in a collapsed, or an uninflated, condition. When deployed, the auxiliary submersible 18 is launched in its folded, or minimum volume, condition while connected to the mother vessel by an umbilical or hose 23 (shown diagrammatically only in FIG. 1). The umbilical 23 may be any suitable means known in the art for transferring gas, liquid, electrical power, hydraulics, pneumatics and the like and may be connected to the inflatable submersible using any suitable connector known in the art. Preferably, both ends of the umbilical 23 is provided with a suitable hose connection which is capable of quick disconnect either by mechanical or electrical means or by exceeding some critical force or pressure level. Any of the conventional underwater, self-sealing, quick disconnect systems known in the art may be employed.

Figure 7:
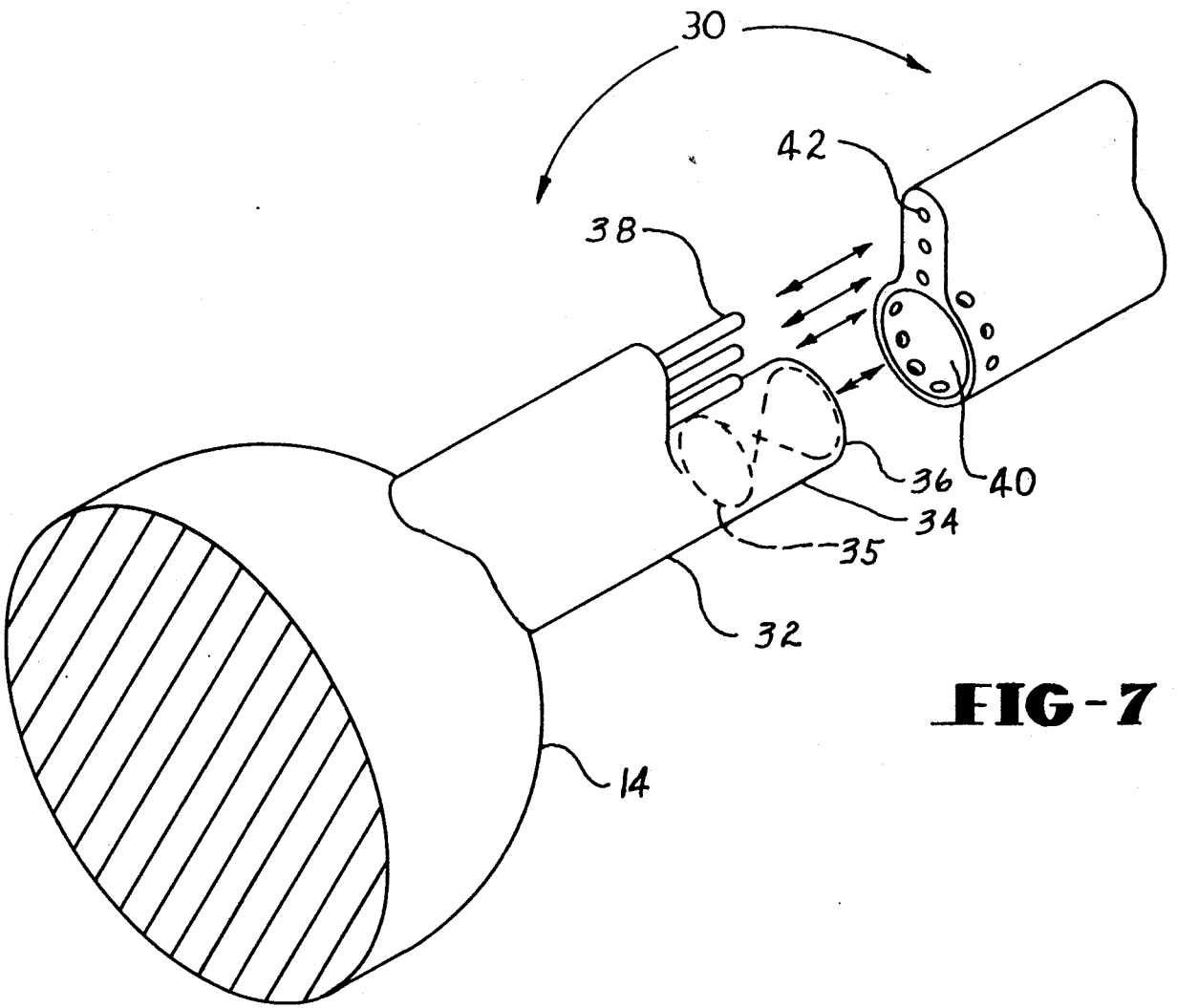
FIG. 7 diagrammatically illustrates a docking system which can be employed in the unitary undersea vehicle system of the present invention.

After launching and inflation are completed, the inflatable auxiliary submersible component 18 is mated to the rigid hull component 14. Preferably, a quick connect/disconnect docking system is provided which allows the two components to be locked to each other, and which allows the transfer of fluid and/or electrical power from the auxiliary submersible to the rigid hull submersible and vice-versa. One such docking system 30 is illustrated in FIG. 7.

The docking system 30 includes a male member 32 illustrated as attached to rigid hull component 14 of the submersible vehicle system, and a female member 34 which would then be attached to the auxiliary submersible component. Alternatively, the orientations of members 32 and 34 to these components may be reversed. The male member 32 includes a rigid or semi-rigid fluid connector 34 with a suitable self-sealing check valve, diagrammatically illustrated as a hidden element 35 adjacent its opening 36, and one or more electrical (or fiber optic) plugs 38. The female member includes a receptacle 40 for receiving the connector 34 and electrical, or fiber optic, receptacles 42 for receiving the plugs 38. If desired, the docking system may include one or more connectors for transferring command power, control signals, and other communications between the two system components.

The principles of the present invention can be further understood by reference to the following operational sequence. The mother vessel 10 first launches the auxiliary submersible component into the water in its uninflated condition and with the umbilical 23 attached thereto. Fuel and/or ballast are then transferred under pressure from the mother vessel 10 to the auxiliary submersible 18 via the umbilical 23 in a controlled manner such that the inflatable submersible erects or inflates with the internal compartments and the internal walls distributing the loads in such a manner as to cause roughly even and symmetric inflation.

The pressure which the system must work to is that of the ambient water plus the differential pressure of the inflatable compartments (which will equalize in the steady state condition). The differential pressure is the motive force needed to keep the internal and external walls of the inflatable semi-rigid. It maintains proper geometry. When the fuel in the auxiliary submersible component is displaced through use in the rigid submersible component or ballast is discharged, the pressure and volume of the auxiliary submersible component can be maintained by backfilling the system with ambient water at ambient pressure or by backfilling and pressurizing/depressurizing with exhaust products from the primary propulsion system or an auxiliary gas/pressure management system (not shown) housed in the rigid submersible component.

After fuel and/or ballast are loaded onboard the now inflated submersible 18, the umbilical 23 is disconnected from the auxiliary submersible which may be restrained near to the mother vehicle. The rigid submersible 14 is then launched by the mother vessel 10 and mated with the inflated submersible component using a docking procedure wherein the rigid submersible 14 is remotely driven into the central opening 24, the sleeve 208 or the sling 244 and locked in place by the docking system 30.

After docking is completed, the integrated rigid hull submersible 14 and the auxiliary submersible 18 are ready to proceed to accomplish their mission. It is to be understood that the mother vehicle, and the integrated rigid hull and auxiliary submersible may be interconnected for signal transmission therebetween, as by an optical fiber telecommunication link.

After the mission is completed, the procedure of defueling the inflatable submersible can be accomplished with or without the rigid submersible in place. Similarly, the process of refueling the inflatable submersible can be carried out with or without the rigid submersible in place.

If desired, the inflatable component can be retrieved after mission completion, collapsed, deflated and stowed on board the mother vessel.

It should be recognized that the use of such an auxiliary submersible vehicle significantly enhances the endurance and mission flexibility of the submersible vehicle system. The system may be fueled from a mother vessel or from other fueling stations (not shown), either submersible or semi-submersible, without incurring any volume penalties due to the configuration of the mother submersible. As a result, few constraints except those imposed by the small rigid submersible, are placed on the physical size, weight and complexity of the launch systems.

The final system of the present invention has an extremely long endurance capability due to the large fuel storage. The final system avoids the shape, weight and volume penalties of an initially large submersible originally positioned inside or adjacent a mother vessel. The system has the ability to be easily refueled at intermediate stations or by other submersibles with a simple docking and refueling mechanism. Still further, the system has the advantage of being easier to retrieve after mission termination by a wide variety of surface and submerged craft or by scuttling.

Another advantage to the system of the present invention is that it lends itself to a wide variety of fuel systems that power a wide variety of power sources. For example, the inflated auxiliary submersible may be used to store liquid hydrocarbon fuel for powering an open-cycle rankine engine aboard the rigid hull submersible. Similarly, liquid metal type fuels such as lithium and an oxidant such as sulfur hexafluoride may be stored aboard the auxiliary submersible to drive a closed cycle rankine or sterling engine. In such systems, however, there would have to be a storage compartment to store spent fuel or, in the alternative, a disposal system aboard the submersible vehicle system.

In yet another alternative, an electrolyte may be stored aboard the auxiliary submersible for powering an electric power system having one or more electric motors powered by a sea water and electrolyte battery. An example of such a battery system would be aluminum silver oxide cells activated by sea water with sodium hydroxide being stored in the auxiliary submersible compartments.

It is apparent that there has been provided in accordance with this invention a inflatable undersea vehicle system of special utility as a daughter to a mother vessel which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A submersible vehicle system comprising:

a submersible having a rigid hull structure and a source of propulsion;

an auxiliary submersible having an inflatable hull structure and central means for receiving a forward portion of said rigid hull submersible, said auxiliary submersible at least partially surrounding said rigid hull structure; and the vehicle system being of a daughter vessel type adapted to be transported to its site of operation aboard a mother vessel containing an on-board fluid source, and means for communicating at least one compartment aboard said auxiliary submersible with the fluid source aboard the mother vessel.

2. The submersible vehicle system of claim 1 wherein said auxiliary submersible has a plurality of compartments for holding a fluid.

3. The submersible vehicle system of claim 1 wherein said auxiliary submersible includes at least one fuel storage compartment and at least one ballast compartment.

4. The submersible vehicle system of claim 1 wherein said auxiliary submersible includes a plurality of fuel compartments and a plurality of ballast compartments.

5. A submersible vehicle system comprising:

a submersible having a rigid hull structure and a source of propulsion;

an auxiliary submersible having an inflatable hull structure and central means for receiving a forward portion of said rigid hull submersible, said auxiliary submersible at least partially surrounding said rigid hull structure;

said rigid hull submersible having a rigid hull structure comprising a torpedo type of undersea vehicle and said auxiliary submersible comprising an inflatable bladder and the central means comprising a cavity in the exterior inflated shape of the bladder which partially surrounds the rigid hull structure, said bladder serving to store at least one of fuel and ballast; and wherein said vehicle system is of a daughter vessel type adapted to be transported to its site of operation aboard a mother vessel and said torpedo and said auxiliary submersible are launched separately from the mother vessel and joined together to form a unitary submersible vehicle while submerged.

6. A submersible vehicle system comprising:

a submersible having a rigid hull structure and a source of propulsion;

an auxiliary submersible having an inflatable hull structure and central means for receiving a forward portion of said rigid hull submersible, said auxiliary submersible at least partially surrounding said rigid hull structure;

said rigid hull submersible having a rigid hull structure comprising a torpedo type of undersea vehicle and said auxiliary submersible comprising an inflatable bladder and the central means comprising a cavity in the exterior inflated shape of the bladder which partially surrounds the rigid hull structure, said bladder serving to store at least one of fuel and ballast;

said vehicle system being of a daughter vessel type adapted to be transported to its site of operation aboard a mother vessel and said torpedo and said auxiliary submersible are launched separately from the mother vessel an joined together to form a unitary submersible vehicle while submerged; and wherein said auxiliary submersible is in a deflated condition prior to launch from the mother vessel and becomes inflated after launch by the storage thereon of said at least one of fuel and ballast.

7. A submersible vehicle system comprising:

a submersible having a rigid hull structure and a source of propulsion;

an auxiliary submersible having in inflatable hull structure and central means for receiving a forward portion of said rigid hull submersible, said auxiliary submersible at least partially surrounding said rigid structure; and said central receiving means comprising a sling attached to a lower surface of said auxiliary submersible.

8. A method of forming a unitary submersible vehicle composed of a rigid hull structure submersible component and an auxiliary inflatable submersible component which comprises:

launching a rigid hull submersible and an inflatable submersible in a deflated condition from a mother vessel;

inflating said inflatable submersible with at least one desired fluid;

mating said rigid hull submersible to said inflated submersible to form the unitary submersible, said mating step being performed underwater;

carrying said at least one fluid aboard said mother vessel;

said launching step comprising launching said rigid hull submersible and said inflatable submersible underwater; and said inflating step comprising inflating said inflatable submersible underwater.

* * * * *